US010294729B2

(12) United States Patent
Serna

(10) Patent No.: US 10,294,729 B2
(45) Date of Patent: May 21, 2019

(54) RISER AND SUBSEA EQUIPMENT GUIDANCE

(71) Applicant: Ensco International Incorporated, Wilmington, DE (US)

(72) Inventor: Juan Carlos Serna, Houston, TX (US)

(73) Assignee: Ensco International Incorporated, Wilmington, DE (US)

( * ) Notice: Subject to any disclaimer, the term of this patent is extended or adjusted under 35 U.S.C. 154(b) by 0 days.

(21) Appl. No.: 15/786,329

(22) Filed: Oct. 17, 2017

(65) Prior Publication Data

US 2019/0112878 A1 Apr. 18, 2019

(51) Int. Cl.
*E21B 17/01* (2006.01)
*E21B 41/00* (2006.01)

(52) U.S. Cl.
CPC ..... *E21B 17/01* (2013.01); *E21B 41/0007* (2013.01)

(58) Field of Classification Search
CPC ..... B63G 8/001; B63G 2008/007; B63G 2008/004; B63G 2008/005; B63G 2008/008; B63G 8/08; B63G 8/22; E21B 2023/008; E21B 33/0355; E21B 33/038; E21B 23/03; E21B 33/064
See application file for complete search history.

(56) References Cited

U.S. PATENT DOCUMENTS

| | | | | |
|---|---|---|---|---|
| 3,265,130 | A * | 8/1966 | Watkins | E21B 33/038 166/342 |
| 6,551,029 | B2 | 4/2003 | Shu et al. | |
| 9,739,101 | B1 | 8/2017 | Li | |
| 9,828,822 | B1 * | 11/2017 | Baez | E21B 33/0355 |
| 2009/0056936 | A1 * | 3/2009 | McCoy, Jr. | E21B 19/002 166/250.01 |
| 2011/0240303 | A1 * | 10/2011 | Hallundbaek | B63C 11/42 166/339 |
| 2013/0220625 | A1 * | 8/2013 | Billington | E21B 19/002 166/336 |
| 2016/0201407 | A1 * | 7/2016 | Haugom | E21B 41/04 166/367 |
| 2016/0298791 | A1 | 10/2016 | Roper et al. | |

* cited by examiner

*Primary Examiner* — James G Sayre
(74) *Attorney, Agent, or Firm* — Fletcher Yoder P.C.

(57) ABSTRACT

Techniques and systems to reduce deflection of a riser suspended from offshore platform. A guidance thrust delivery system (GTDS) includes a plurality of thrusters configured to be coupled to a riser of an offshore vessel. Each thruster of the plurality of thrusters is configured to generate a force on the riser of the offshore vessel to control a position of the riser in a subsea environment while the riser is suspended from the offshore vessel and decoupled from a seafloor.

19 Claims, 4 Drawing Sheets

RISER AND SUBSEA EQUIPMENT GUIDANCE

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Advances in the petroleum industry have allowed access to oil and gas drilling locations and reservoirs that were previously inaccessible due to technological limitations. For example, technological advances have allowed drilling of offshore wells at increasing water depths and in increasingly harsh environments, permitting oil and gas resource owners to successfully drill for otherwise inaccessible energy resources. To drill for oil and gas offshore, it is desirable to have stable offshore platforms and/or floating vessels from which to drill and recover the energy resources. Techniques to stabilize the offshore platforms and floating vessels include, for example, the use of mooring systems and/or dynamic positioning systems. However, these systems may not always adequately stabilize components descending from the offshore platforms and floating vessels to the seafloor wellhead.

For example, a riser string (e.g., a tubular or series of tubulars that connects the offshore platforms or floating vessels to the floor of the sea) may be used to transport drill pipe, casing, drilling mud, production materials or hydrocarbons between the offshore platform or floating vessel and a wellhead. The riser string, or riser, is suspended between the offshore platform or floating vessel and the wellhead, and may experience forces, such as underwater currents, that cause deflection (e.g., bending or movement) in the riser. Acceptable deflection can be measured by the deflection along the riser, and also at, for example, select points along the riser. These points may be located, for example, at or near the offshore platform or floating vessel and/or at or near the wellhead. If the deflection resulting from underwater current is too great, deployment and/or retrieval of the riser must cease and the wellhead may not be accessible due to such technological constraints. Additionally, movement (e.g., installation, removal, maintenance) of the riser may be delayed so that a minimum distance between the riser and other subsea structures may be maintained, thereby increasing costs. Moreover, installation of the riser may be prohibited at some locations due to the subsea environment (e.g., current), existing subsea structures, and an appropriate minimum operating distance from the existing subsea structures. Accordingly, it would be desirable to provide techniques to stabilize riser deployment and/or retrieval in offshore drilling and energy resource recovery environments.

BRIEF DESCRIPTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In a first embodiment, a guidance thrust delivery system (GTDS) includes a plurality of thrusters. Each thruster of the plurality of thrusters is configured to generate a force on a riser of an offshore vessel to control a position of the riser in a subsea environment while the riser is suspended from the offshore vessel and decoupled from a seafloor.

In a second embodiment, a guidance thrust delivery system (GTDS) includes a plurality of thrust units configured to be coupled to a riser of an offshore vessel, to subsea equipment coupled to the riser, or any combination thereof. The GTDS includes a controller coupled to the plurality of thrust units. The plurality of thrust units is configured to generate one or more forces on the riser of the offshore vessel to control a position of the riser in a subsea environment while the riser is suspended from the offshore vessel and decoupled from a seafloor. The controller is configured to control the plurality of thrust units to generate the one or more forces on the riser.

In a third embodiment, a method includes controlling a guidance thrust delivery system (GTDS) to control a position of a riser in a subsea environment while the riser is suspended from an offshore vessel and decoupled from a seafloor. The GTDS is coupled to the riser of the offshore vessel, to subsea equipment coupled to the riser, or any combination thereof. The GTDS includes a plurality of thrusters. The plurality of thrusters is configured to generate one or more forces on the riser of the offshore vessel to control the position of the riser.

DETAILED DESCRIPTION

One or more specific embodiments will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements.

Systems and techniques for stabilizing a riser suspended from an offshore vessel, such as a drillship, a semi-submersible platform, a floating production system, or the like, are set forth below. The system and techniques described herein may be utilized to control the position of one or more points (e.g., midpoint, end) of the riser while it is suspended from the offshore vessel and not coupled to the seafloor. That is, the position of one or more points of the riser may be controlled while the offshore vessel is moving with the riser suspended from the offshore vessel, while the riser is being moved between the seafloor and the offshore vessel, or any combination thereof. In one embodiment, a guidance thrust delivery system (GTDS) coupled to the one or more points of the riser may actively control the position of the riser while it is moving toward the seafloor for installation. In one embodiment, the GTDS coupled to the one or more points of the riser may actively control the position of the riser while it is moving from the seafloor for retrieval. The GTDS may also enable improved control of the position of the riser when a portion of the riser is disconnected from a component (e.g., blow out preventer (BOP) or a subsea structure) while suspended from the offshore vessel. The GTDS may include a unit with single or multiple thrusters to actively control the position of the riser. In some embodiments, the GTDS may include multiple units with one or more thrusters to actively control the position of the riser. The one or more units of the GTDS may be detached from a first location of the riser and removably coupled to other locations of the riser while in the subsea environment.

Figure 1:
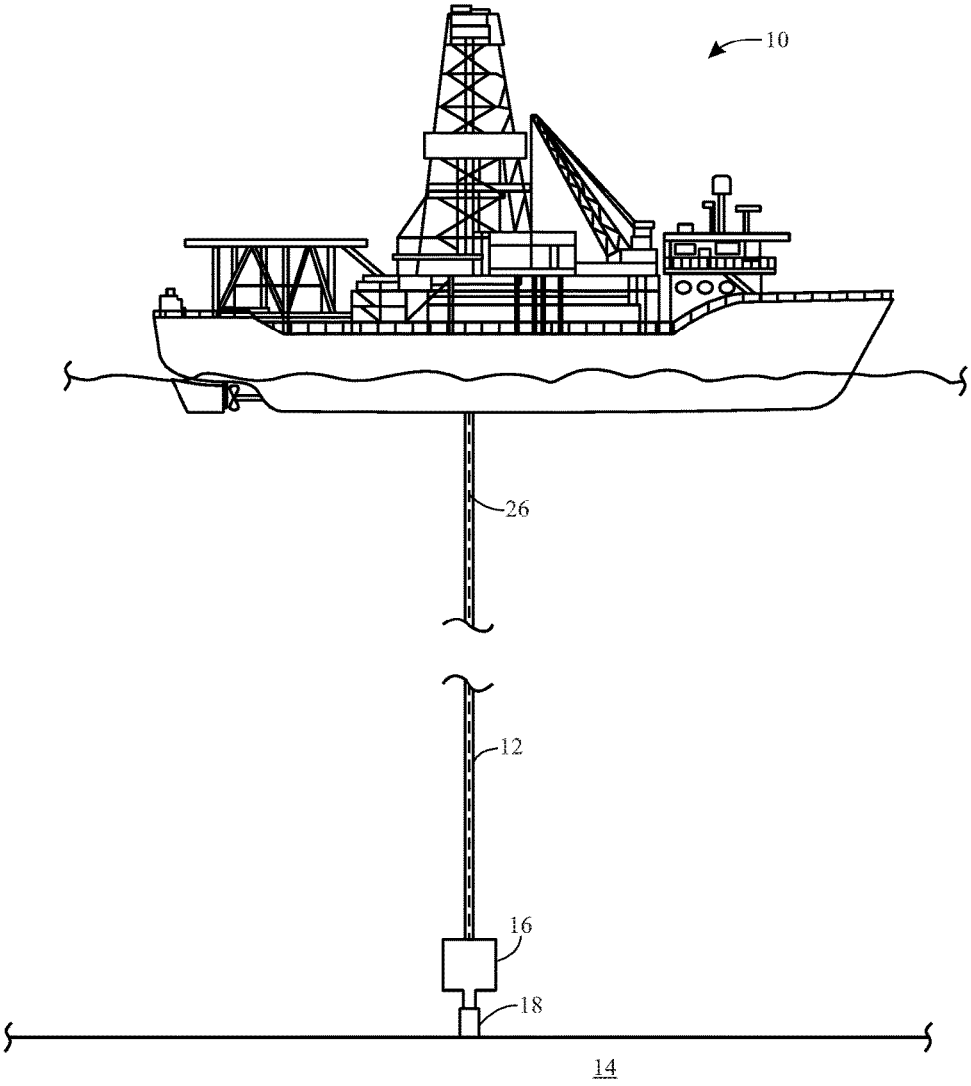
FIG. 1 illustrates an example of an offshore vessel having a riser, in accordance with an embodiment.

With the foregoing in mind, FIG. 1 illustrates an offshore vessel 10. Although the presently illustrated embodiment of an offshore vessel 10 is a drillship (e.g., a ship equipped with a drill rig and engaged in offshore oil and gas exploration and/or well maintenance or completion work including, but not limited to, casing and tubing installation, subsea tree installations, and well capping), other offshore vessels such as a semi-submersible platform, a floating production system, or the like may be substituted for the offshore vessel 10. Indeed, while the techniques and systems described below are described in conjunction with drillship 10, the stabilization techniques and systems are intended to cover at least the additional offshore vessels described above, and their associated tasks and equipment.

As illustrated in FIG. 1, the offshore vessel 10 includes a derrick 11 and a riser 12 extending therefrom. The riser 12 may include a tubular 26 or a series of tubulars that connect the offshore vessel 10 to the seafloor 14 via, for example, a blow out preventer (BOP) 16 that is coupled to a wellhead 18 on the seafloor 14. In some embodiments, the riser 12 may transport produced hydrocarbons and/or production materials between the offshore vessel 10 and the wellhead 18, while the BOP 16 may include at least one valve with a sealing element to control wellbore fluid flows. In some embodiments, the riser 12 may pass through an opening (e.g., a moonpool) in the offshore vessel 10 and may be coupled to drilling equipment of the offshore vessel 10. As illustrated in FIG. 1, it may be desirable to have the riser 12 positioned in a vertical orientation between the wellhead 18 and the offshore vessel 10. However, external factors (e.g., environmental factors such as currents) may disturb the vertical orientation of the riser 12. Control of the position of one or more points of the riser 12 below the offshore vessel 10 may affect the orientation of the riser 12 relative to the opening in the offshore vessel 10.

Figure 2:
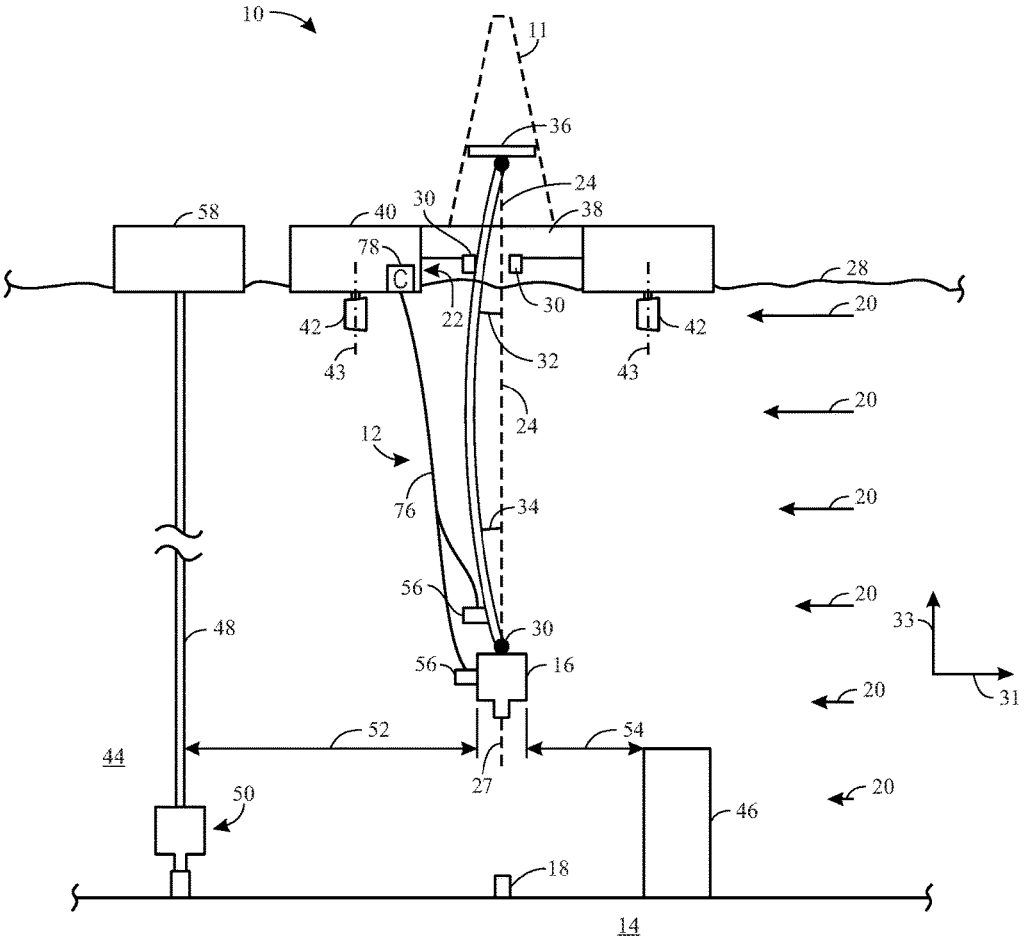
FIG. 2 illustrates an example of the offshore vessel of FIG. 1 having a riser experiencing deflection, in accordance with an embodiment.

As illustrated in FIG. 2, the riser 12 may experience deflection, for example, from currents 20. These currents 20 may, for example, apply up to and in excess of 100 pounds of force per foot on the riser 12, which causes deflection (e.g., motion, bending, or the like) in riser 12. The currents 20 between a sea surface 28 and the seafloor 14 may vary in magnitude, direction, or both. This force applied to the riser 12 may cause the riser 12 to contact an edge 22 of a moonpool 38 or a diverter housing 30 of the offshore vessel 10 unless the position of the offshore vessel 10 is adjusted, the position of the riser 12 is adjusted, or some combination thereof. As may be appreciated, a diverter housing 30 may be disposed about the riser 12 at or above sea surface 28. Forces applied to the riser 12 between the sea surface 28 and the seafloor 14 may cause the riser 12 to interface with the diverter housing 30 and/or edges 22 of the offshore vessel 10 unless the position of the offshore vessel 10 is adjusted, the position of the riser 12 is adjusted, or some combination thereof. Additionally and/or alternatively, the force applied to the riser 12 from the currents 20 (or other environmental forces) may cause the riser 12 to stress the BOP 16 or cause key seating, as an angle 34 that the riser 12 contacts the BOP 16 may be affected via the deflection of the riser 12. Moreover, the currents 20 (or other environmental forces) may move the position of the BOP 16 relative to the offshore vessel 10. That is, a centerline 27 of the BOP 16 may be offset in a lateral direction 31 from a centerline 24 of the moonpool 38 from which the riser 12 extends. To reduce the deflection of the riser 12, and to reduce the chances of occurrence of the aforementioned problems caused by riser 12 deflection, one or more systems and techniques may be employed.

The offshore vessel 10 may adjust its lateral position on the sea surface 28 to control an angle 32 between the centerline 24 of the moonpool 38 and the riser 12 beneath a drill floor 36, to control an angle 34 between the centerline 27 of the BOP 16 and the riser 12, or to control a position of the BOP 16 under the sea surface 28, or any combination thereof. In some embodiments, the offshore vessel 10 may include one or more thrusters 42. The one or more thrusters 42 may enable the position of the offshore vessel 10 to be adjusted in a lateral direction 31 along the sea surface 28. Control of the operation and/or the positioning of the thrusters 42 may be performed utilizing a dynamic positioning system that may, for example, operate to reduce the effects of surge, sway, and yaw. That is, the operation and/or the positioning of the thrusters may facilitate control of the offshore vessel in a horizontal plane inclusive of lateral directions 31. The one or more thrusters 42 may be oriented in fixed directions. In some embodiments, the orientation of one or more thrusters 42 is adjustable. For example, an azimuthing thruster disposed along an axis 43 may be rotatable around the axis, such that the angle of the azimuthing thruster may adjusted to generate forces on the riser 12 in multiple directions (e.g., lateral directions). The offshore vessel 10 may be moved along the surface 28 to reduce the angle 32 between the centerline 26 of the moonpool 38, thereby reducing or eliminating contact of the riser 12 with the edge 22 of the moonpool 38 through a hull 40 and/or the diverter housing 30 of the offshore vessel 10.

A subsea environment 44 may include, but is not limited to, the wellhead 18 that the riser 12 is to couple with the offshore vessel 10, subsea structures 46 (e.g., natural structures, artificial structures), other risers 48, and subsea equipment 50. It may be desirable to maintain a minimum distance between the riser 12 and elements of the subsea environment 44. Additionally, it may be desirable to maintain a minimum distance between components (e.g., BOP 16) of the riser 12 or coupled to the riser 12 and elements of the subsea environment 44. For example, a riser minimum distance 52 between the riser 12 and another riser 48 may be between 5 to 1000 ft, 10 to 100 ft, or 20 to 50 ft, or any distance therein. A structure minimum distance 54 between the riser 12 and subsea structures 46 may be greater than 5, 10, 25, 50, or 100 ft or more. The forces of the currents 20 (or other environmental forces) may prevent the offshore vessel 10 from moving the riser 12 and BOP 16 between the sea surface 28 and the seafloor 14 unless the appropriate minimum distances may be otherwise maintained while moving the riser 12.

As discussed herein, a guidance thrust delivery system (GTDS) 56 may enable control of the position of the riser 12 and subsea equipment attached thereto, for example, the BOP 16, in the subsea environment 44 to compensate for the forces of the currents 20. Additionally, or in the alternative, the GTDS 56 may enable control of the position of the riser 12 and subsea equipment attached thereto in the subsea environment 44 to maintain appropriate minimum distances (e.g., riser minimum distance 52, structure minimum distance 54). While the BOP 16 is discussed below and illustrated as the subsea equipment attached to the riser 12, it is to be understood that the GTDS 56 may be coupled to and/or otherwise control the position of other types of subsea equipment attached to the riser 12. That is, the subsea equipment attached to the riser 12 may include, but is not limited to, the BOP 16. The BOP 16 or other subsea equipment may be coupled to an end of the riser 12 opposite the offshore vessel 10, or near (e.g., within approximately 35, 25, 15, 10, or 5 ft) of the end of the riser 12 opposite the offshore vessel 10. Moreover, while the riser 12 is discussed below and illustrated as coupling with the subsea equipment (e.g., the BOP 16), it may be understood that the GTDS 56 described herein may be utilized with other means of deploying the subsea equipment. For example, the GTDS 56 may be utilized to directly or indirectly control the position of subsea equipment coupled to the riser 12, to drill pipe, to casing, to coil tubing, and to wireline.

The GTDS 56 may be utilized during installation of subsea equipment (e.g., the BOP 16) on the seafloor 14, retrieval of subsea equipment (e.g., the BOP 16) from the seafloor 14, or movement of the offshore vessel 10 while the riser 12 extends toward the seafloor 14. For example, the GTDS 56 may enable the subsea equipment (e.g., the BOP 16) to maneuver within the subsea environment 44 while the offshore vessel 10 moves along the sea surface 28 at speeds greater than 0.2, 0.5, 0.8, 1.0, or 2.0 knots or more with the riser 12 suspended from the offshore vessel 10 and extended toward the seafloor 14. That is, the GTDS 56 may enable the subsea equipment coupled to the riser 12 to maintain a desired distance from subsea structures 46 within the subsea environment 44 while the offshore vessel 10 moves along the sea surface 28, particularly at speeds greater than 0.2, 0.5, 0.8, 1.0, or 2 knots. In some embodiments, the GTDS 56 is coupled to one or more locations along the riser 12 to directly control the position of the riser 12 in the subsea environment 44. Additionally, or in the alternative, the GTDS 56 is coupled to one or more locations of the BOP 16 or other types of subsea equipment. It may be appreciated that use of the GTDS 56 coupled to one or more locations of the BOP 16 or other subsea equipment may enable indirect control of the position of the riser 12 in the subsea environment 44.

The GTDS 56 may have one or more thrusters configured to exert forces on the BOP 16 and the riser 12 in a lateral direction 31, the vertical direction 33, or any combination thereof. Additionally, or in the alternative, the GTDS 56 may include one or more thrust units coupled to the BOP 16, to the riser 12, or to both the BOP 16 and to the riser 12, where each thrust unit includes one or more thrusters. As discussed herein, the GTDS 56 may be utilized to control the position of the riser 12 and the BOP 16 within the subsea environment 44. While some of the embodiments described herein discuss the GTDS 56 coupled to the BOP 16, it may be understood that the elements of the GTDS 56 may be coupled to one or more locations of the riser 12, including the BOP 16 near an end of the riser 12. For example, elements of the GTDS 56 may be coupled to the riser 12 within 100, 50, 10, 5, or 1 ft or less of a subsea end of the riser 12. Furthermore, it may be appreciated that the lateral direction 31 is not limited to the direction of the arrow illustrated in FIG. 2, but rather may include any direction in a plane perpendicular to the vertical direction 33 generally parallel to the sea surface 28. That is, the lateral direction 31 is defined herein to include a direction that is within 10 degrees of horizontal plane along the sea surface 28.

Control of the position of the BOP 16 via the GTDS 56 while the riser 12 is suspended from the offshore vessel 10 may enable the offshore vessel 10 to operate and deploy/retract the riser 12 and subsea equipment attached thereto near a second offshore vessel 58 with its second riser 48. The GTDS 56 may be configured to control the position of the BOP 16 and the riser 12 to reduce or eliminate any interference between the riser 12 and the second riser 48. In some embodiments, the GTDS 56 may enable the offshore vessel 10 itself to deploy/retract the riser 12 and subsea equipment attached thereto while the offshore vessel 10 is simultaneously coupled to the second riser 48. That is, the GTDS 56 may enable the offshore vessel 10 to deploy multiple risers while maintaining an appropriate minimum riser distance 52 between risers 12, 48 during movement of the riser 12 between the seafloor 14 and the sea surface 28.

Figure 3:
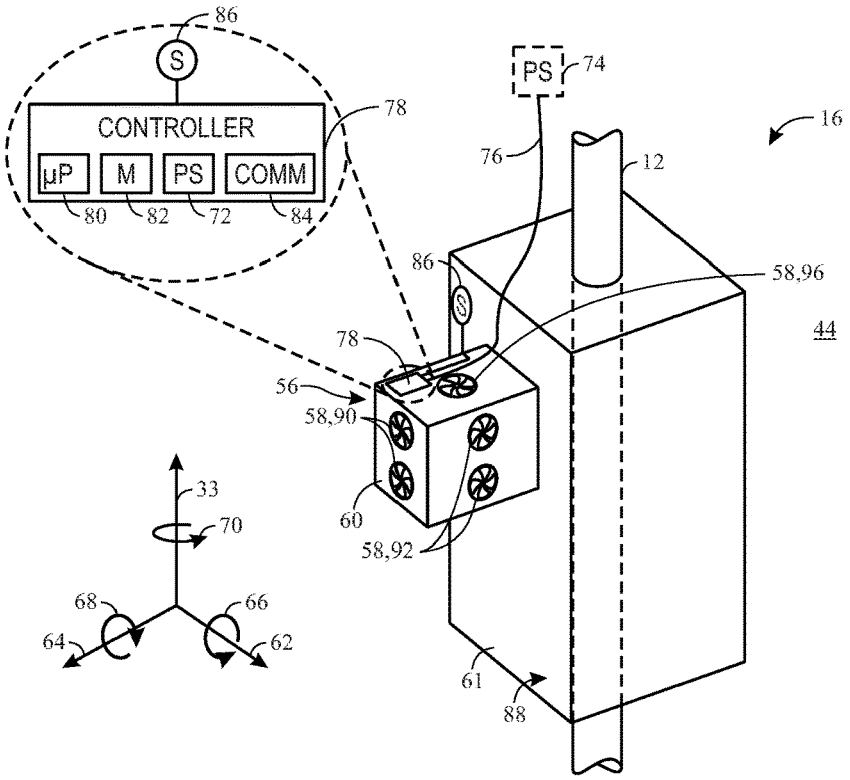
FIG. 3 illustrates an embodiment of a guidance thrust delivery system (GTDS) with a thrust unit coupled to the riser suspended from the offshore vessel, in accordance with an embodiment.

FIG. 3 illustrates an embodiment of the GTDS 56 coupled to the BOP 16 on the riser 12 deployed by the offshore vessel 10. The GTDS 56 shown in FIG. 3 includes multiple thrusters 58 of a single thrust unit 60. Each thruster 58 of the thrust unit 60 is configured to generate a force in a known direction on the GTDS 56, which in turn exerts forces on the BOP 16 and the riser 12 coupled to the GTDS 56. In some embodiments, the thrust unit 60 of the GTDS 56 is coupled to a frame 61 of the BOP 16. The thrust unit 60 may be permanently affixed to the frame 61 or the riser 12, such as via welding or brazing. The thrust unit 60 may be removably affixed to the frame 61 or the riser 12, such as via fasteners, clamps, and so forth. The thrusters 58 of the GTDS 56 may be oriented to generate forces along the vertical direction 33, a first lateral direction 62, a second lateral direction 64, or any combination thereof. That is, the thrusters 58 of the GTDS 56 may provide three degrees of freedom of movement for the BOP 16 in the subsea environment 44. Moreover, the disposition of the thrust unit 60 coupled to the BOP 16 and the disposition of the one or more thrusters 58 of the thrust unit 60 of the GTDS 56 may cause rotation of the BOP 16 in a first rotation direction 66, a second rotation direction 68, a third rotation direction 70, or any combination thereof.

Through control of the one or more thrusters 58 of the thrust unit 60 of the GTDS 56, the position and orientation of the BOP 16 in the subsea environment 44 may be controlled. That is, the thrust unit 60 of the GTDS 56 may be coupled to the BOP 16 or to the riser 12 directly to enable movement of the riser 12 in the subsea environment 44 with three degrees of freedom. In some embodiments, the GTDS 56 may include multiple thrust units 60 coupled to the BOP 16 or to the riser 12. In some embodiments, multiple thrust units 60 of the GTDS 56 may be detached from a first location of the riser 12, and removably attached to a second location of the riser 12 while in the subsea environment 44. Each thrust unit 60 of the GTDS 56 may include one or more thrusters 58 as described below.

In some embodiments, the thrusters 58 are electrically driven thrusters. While electrically driven thrusters are discussed below, it may be appreciated that some embodiments of the thrusters 58 may be hydraulically driven thrusters. In some embodiments, one or more of the thrusters 58 is an azimuthing thruster that is rotatable about an axis, thereby enabling the azimuthing thruster to exert a force on the BOP 16 in multiple directions at separate times. The thrusters 58 may be powered by one or more local power sources 72 (e.g., batteries) or a remote power source 74 (e.g., power source on the offshore vessel 10, power source on the riser 12). The one or more local power sources 72 may be disposed within the thrust unit 60, coupled to the thrust unit 60, or disposed on the BOP 16. A controller 78 of the thrust unit 60 of the GTDS 56 may be coupled to the one or more local power sources 72 and control the distribution of power from the one or more local power sources 72 to the one or more thrusters 58. In some embodiments, the remote power source 74 supplies power to the one or more thrusters 58 via an umbilical line 76 coupled to the thrust unit 60 of the GTDS 56. Moreover, embodiments of the controller 78 may be disposed remotely and transmit signals along the umbilical line 76. For example, the controller 78 may be remotely disposed on the offshore vessel 10, thereby enabling control of the GTDS 56 without exposing elements of the controller 78 to the subsea environment.

The controller 78 may operate in conjunction with software systems implemented as computer executable instructions stored in a non-transitory machine readable medium of a the controller 78, such as a memory 82, a hard disk drive, or other short term and/or long term storage. Particularly, the techniques described below with respect to controlling the position of the GTDS 56 in the subsea environment 44 may be accomplished, for example, using code or instructions stored in a non-transitory machine readable medium of the controller 78 (such as the memory 82) and may be executed, for example, by a processing device 80 of the controller 78 to control the one or more thrusters 58.

Thus, the controller 78 may be a general purpose or a special purpose computer that includes the processing device 80, such as one or more application specific integrated circuits (ASICs), one or more processors, or another processing device that interacts with one or more tangible, non-transitory, machine-readable media (e.g., memory 82) of the controller 78 that collectively stores instructions executable by the processing device 80 to perform the methods and actions described herein. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by the processing device 80. In some embodiments, the instructions executable by the processing device 80 are used to generate, for example, control signals to be transmitted to, for example, one or more of the thrusters 58. In some embodiments, the controller 78 may communicate (e.g., transmit control signals, receive control signals) with the offshore vessel 10 via communications circuitry 84. In some embodiments, the controller 78 executes instructions to automatically control the one or more thrusters 58 of the GTDS 56 to control the position and orientation of the BOP 16 in the subsea environment 44, such as to maintain a minimum distance 54 from a subsea structure 46. In some embodiments, the controller 78 enables an operator to remotely control the one or more thrusters 58 of the GTDS 56 to control the position and orientation of the BOP 16 in the subsea environment 44. For example, an operator may remotely control the GTDS 56 from the offshore vessel 10 or another location (e.g., submersible, land-based facility) in wired or wireless communication with the GTDS 56.

The controller 78 may be coupled to one or more sensors 86 in the subsea environment 44. The one or more sensors 86 may be integrated with the thrust unit 60 of the GTDS 56, coupled to the BOP 16, coupled to the riser 12 or any combination thereof. The one or more sensors 86 may provide sensor data to the controller 78 to determine motion of the GTDS 56, an orientation of the GTDS 56 relative to one of the directions 33, 62, and/or 64, the position of the GTDS 56 relative to the offshore vessel 10, the position of the GTDS 56 relative to the wellhead 18, the position of the GTDS 56 relative to subsea structures 46 (e.g., natural structures, other risers 48, subsea equipment 50), the speed of the currents of the subsea environment 44, or any combination thereof. The controller 78 may be configured to control the thrusters 58, and thereby the position and orientation of the GTDS 56 and the BOP 16 based at least in part on the sensor data provided by the one or more sensors 86 of the GTDS 56.

While the thrust unit 60 of the GTDS 56 of FIG. 3 is shown to be coupled to a first face 88 of the BOP 16, it may be appreciated that some embodiments of the thrust unit 60 may be coupled to other faces of the BOP 16. The one or more thrusters 58 of the thrust unit 60 exert forces on the BOP 16 and the riser 12 through the connection between the thrust unit 60 of the GTDS 56 and the BOP 16 or the riser 12. In some embodiments, the thrust unit 60 may have multiple first thrusters 90 and/or a stronger first thruster 90 configured to exert a force that is perpendicular to the first face 88 to which the thrust unit 60 is coupled (i.e., a force in the second lateral direction 64). In such an embodiment, the thrust unit 60 may have fewer thrusters 92 and/or a weaker thrusters 92 configured to exert forces that are not perpendicular to the first face 88 (i.e., forces in the vertical direction 33 or the first lateral direction 62). The thrusters 92 may be configured to adjust the orientation of the BOP 16 to enable the thrusters 90 to act upon the BOP 16 in the desired direction.

Figure 4:
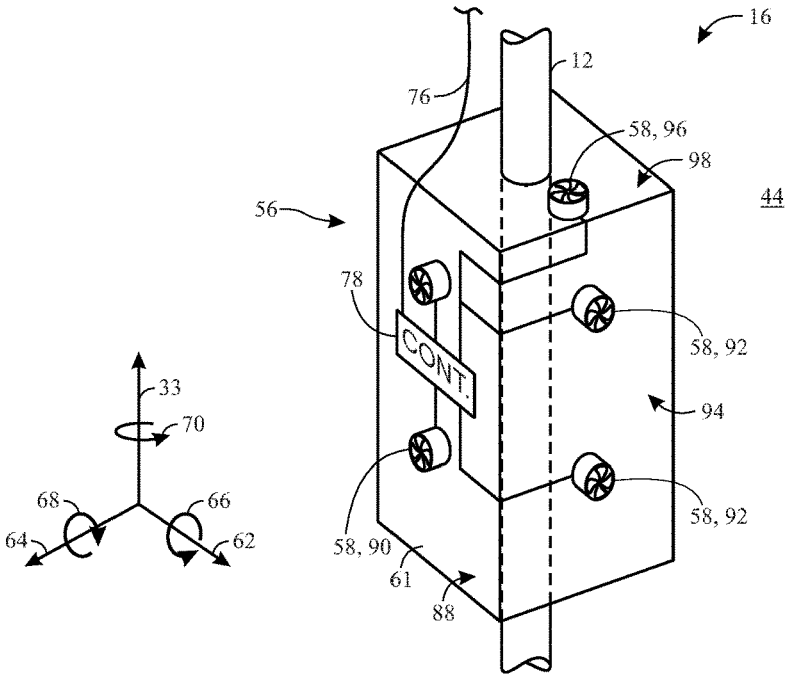
FIG. 4 illustrates an embodiment of a guidance thrust delivery system (GTDS) with multiple thrusters separately coupled to the riser suspended from the offshore vessel, in accordance with an embodiment.

FIG. 4 illustrates an embodiment of the GTDS 56 with multiple thrusters 58 separately coupled to the riser 12 or subsea equipment attached thereto and deployed/retracted by the offshore vessel 10. The multiple thrusters 58 may be directly coupled to the BOP 16, to a frame 61 of the BOP 16, to the riser 12, or any combination thereof. Accordingly, as discussed herein, thrusters 58 coupled to the BOP 16 includes thrusters 58 coupled to the frame 61 of the BOP 16 and thrusters 58 directly coupled to the BOP 16. In some embodiments, one or more of the thrusters 58 is an azimuthing thruster configured to rotate about an axis, thereby enabling the respective thruster 58 to exert a force on the BOP 16 from multiple directions.

The disposition of the thrusters 58 (e.g., first thrusters 90, second thrusters 92, third thrusters 96) separately coupled to the BOP 16 may be controlled to provide three degrees of freedom of movement for the BOP 16 in the subsea environment 44. As discussed above, the disposition of the thrusters 58 of the GTDS 56 may cause rotation of the BOP 16 in a first rotation direction 66, a second rotation direction 68, a third rotation direction 70, or any combination thereof. Through control of the one or more thrusters 58 of the GTDS 56, the position and orientation of the BOP 16 in the subsea environment 44 may be controlled.

One or more first thrusters 90 may be disposed on the first face 88 of the BOP 16, one or more second thrusters 92 may be disposed on a second face 94 of the BOP 16, and one or more thrusters 96 may be disposed on a third face 98 of the BOP 16. In some embodiments, thrusters 58 may be disposed on only one face (e.g., only the first face 88, only the second face 94, only the third face 98) or on only two faces (e.g., first face 88 and the second face 94, the first face 88 and the third face 98, the second face 94 and the third face 98). Additionally, or in the alternative, one or more thrusters 90 may be disposed on multiple faces of the BOP 16, such as on each of the vertical faces of the BOP 16, thereby enabling the thrusters 90 of the GTDS 56 to control lateral movement of the GTDS 56 in the subsea environment 44.

The thrusters 58 may be powered by one or more local power sources 72 (e.g., batteries) or a remote power source 74 (e.g., power source on the offshore vessel 10, power source on the riser 12). The controller 78 may be coupled to and control the distribution of power to the separate thrusters 58 coupled to the BOP 16. In some embodiments, the umbilical line 76 coupled to the offshore vessel 10 provides signals (e.g., power, control signals) to the separate thrusters 58 of the GTDS 56. Additionally, or in the alternative, the umbilical line 76 is coupled to the controller 78, which controls the separate thrusters 58 of the GTDS 56 to adjust the position and/or the orientation of the BOP 16 in the subsea environment 44. The controller 78 may be disposed in the subsea environment 44 (e.g., coupled to the riser 12, coupled to the BOP 16, coupled to subsea equipment) or disposed remotely (e.g., disposed on the offshore vessel 10) such that the controller 78 communicates with the GTDS 56 via the umbilical line 76.

Figure 5:
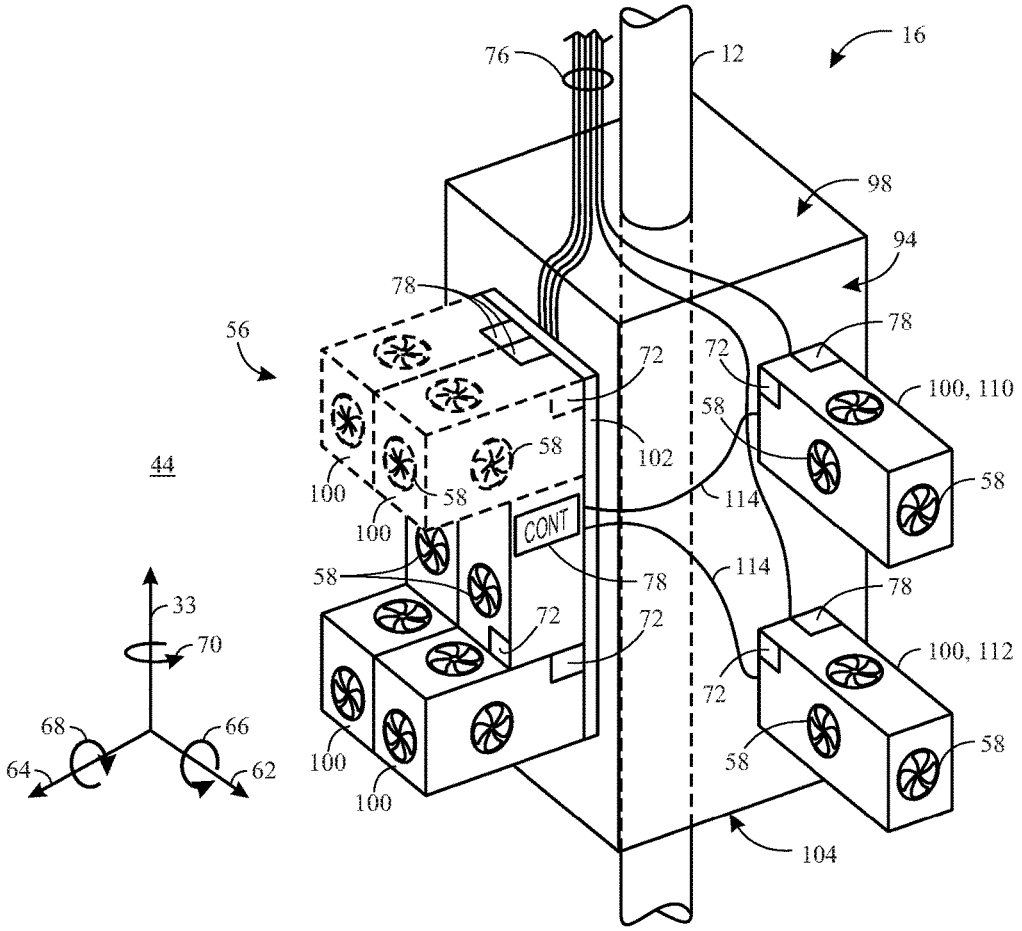
FIG. 5 illustrates an embodiment of a guidance thrust delivery system (GTDS) with detachable units coupled to the riser suspended from the offshore vessel, in accordance with an embodiment.

FIG. 5 illustrates an embodiment of the GTDS 56 with detachable thrust units 100 coupled to the riser 12. The detachable thrust units 100 may be configured to removably couple with a skid 102 coupled to the BOP 16. The skid 102 with the detachable thrust units 100 may be coupled to the BOP 16 while the BOP 16 is on or near the offshore vessel 10 and the sea surface 28. In some embodiments, the skid 102 includes one or more of the local power source 72, the controller 78, and one or more thrusters 58. As discussed above, the controller 78 may be disposed remotely, such as on the offshore vessel 10, and communicate to the detachable thrust units 100 of the GTDS 56 via the umbilical line 76. One or more skid thrusters 58 of the skid 102 may enable the skid 102 to exert a force on the BOP 16 and the riser 12 while the detachable thrust units 100 are disposed at other locations in the subsea environment 44, as discussed below.

While the BOP 16 and the coupled skid 102 are disposed in the subsea environment 44, one or more of the detachable thrust units 100 may be detached from the skid 102 at a first location of the riser 12, and removably coupled to another location of the BOP 16 or the riser 12. That is, each of the detachable thrust units 100 of the GTDS 56 may be removed from the skid 102 at a first location (e.g., on the first face 88), moved about the BOP 16, and removably coupled to another location (e.g., on the second face 94) of the BOP 16. Moreover, the detachable thrust units 100 may be controlled and moved to be recoupled (e.g., docked) with the skid 102, such as for retrieval of the GTDS 56. The detachable thrust units 100 of the GTDS 56 may be removably coupled to one or more locations along the riser 12 or one or more locations of the BOP 16 during installation of the BOP 16 on the seafloor 14, during retrieval of the BOP 16 from the seafloor 14, or during movement of the offshore vessel 10 along the sea surface 28.

Each of the detachable thrust units 100 of the GTDS 56 includes one or more thrusters 58. In some embodiments, the detachable thrust units 100 may include remotely operated underwater vehicles (ROVs). In some embodiments, each detachable thrust units 100 includes thrusters 58 that provide three degrees of freedom of movement for the respective ROV in the subsea environment 44. The detachable thrust units 100 may be removably coupled to various locations of the BOP 16 or the riser 12. For example, one or more of the detachable thrust units 100 may be removably coupled to the first face 88, the second face 94, the third face 98, a fourth face 104, or another face of the BOP 16. FIG. 5 illustrates a first detachable thrust unit 110 and a second detachable thrust unit 112 coupled to the second face 94 of the BOP 16, where the first and second detachable thrust units 110, 112 may be coupled to the skid 102 as shown with the dashed lines. By removably coupling the detachable thrust units 100 to various locations about the BOP 16, the detachable thrust units 100 of the GTDS 56 may be controllably arranged to collectively exert a desired force on the BOP 16, thereby providing three degrees of freedom of movement for the BOP 16. In some embodiments, multiple detachable thrust units 100 may be coupled to a face (e.g., second face 94) of the BOP 16 to increase the force from the GTDS 56 on that face. For example, it may be desirable to have 1, 2, 3, 4, 5, 6, 7, or more detachable thrust units 100 coupled to one face of the BOP 16 to control the position and orientation of the BOP 16 despite strong currents 20. As may be appreciated, the desired force on the BOP 16 to control the position and orientation of the BOP in the subsea environment 44 may vary over time and with the depth of the BOP 16. Accordingly, the detachable thrust units 100 enable the forces on the BOP 16 by the GTDS 56 to be readily varied over time and with the depth of the BOP 16 while the riser 12 is suspended from the offshore vessel 10 and not coupled to the seafloor 14.

In some embodiments, the detachable thrust units 100 are each powered by a respective local power source 72 (e.g., batteries). In some embodiments, each detachable thrust unit 100 is powered by a local power source 72 of the skid 102. Moreover, the detachable thrust units 100 may be coupled to the skid 102 via ROV umbilicals 114, which provide signals (e.g., power, control signals) to the respective detachable thrust units 100 from the controller 78. In some embodiments, each detachable thrust unit 100 is coupled to the offshore vessel 10 via a respective umbilical line 76. The umbilical lines 76 may provide remote signals (e.g., power, control signals) to the detachable thrust units 100, thereby enabling the detachable thrust units 100 to be remotely powered, remotely controlled, or both remotely powered and remotely controlled, such as from the offshore vessel 10. In some embodiments, one or more of the detachable thrust units 100 have a respective controller 78 configured to control the thrusters 58 of the respective detachable thrust unit 100. As discussed above, each controller 78 may receive sensor data from one or more sensors 86 of the GTDS 56 system. Accordingly, a first controller 78 of the first detachable thrust unit 110 may control the respective thrusters 58 of the first detachable thrust unit 110 based at least in part on the received sensor data.

The GTDS described above may provide increased control of the position and the orientation of subsea equipment (e.g., the BOP) and the riser in the subsea environment while the subsea equipment is suspended from the offshore vessel. The GTDS may counteract forces in the subsea environment, such as currents, by exerting forces on one or more locations of the subsea equipment or the riser, thereby reducing or eliminating interference (e.g., contact) of the riser with the moonpool edges of the offshore vessel or equipment at the sea surface 28 (e.g., the diverter housing). Additionally, the GTDS may exert forces on one or more locations of the subsea equipment or the riser to reduce stresses on the riser, to reduce deflection of the riser, to control the position of the subsea equipment and the riser relative to structures in the subsea environment, to control the position or orientation of the riser in the moonpool of the offshore vessel, to control the position or orientation of the riser in the diverter housing, or any combination thereof. The GTDS described above may increase the ability of operators of the offshore vessel to move the offshore vessel while the riser is extended from the offshore vessel, to operate the offshore vessel in adverse weather conditions and/or sea conditions, or any combination thereof. Moreover, the GTDS described above may increase the ability of the offshore vessel to install or retrieve subsea equipment from the seafloor while maintaining a minimum desired distance from proximate natural or artificial subsea structures in the subsea environment.

This written description uses examples to disclose the above description, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims. Accordingly, while the above disclosed embodiments may be susceptible to various modifications and alternative forms, specific embodiments have been shown by way of example in the drawings and have been described in detail herein. However, it should be understood that the embodiments are not intended to be limited to the particular forms disclosed. Rather, the disclosed embodiment are to cover all modifications, equivalents, and alternatives falling within the spirit and scope of the embodiments as defined by the following appended claims.

What is claimed is:

1. A system, comprising:

a guidance thrust delivery system (GTDS) comprising a plurality of thrusters, wherein each thruster of the plurality of thrusters is configured to generate a force on a riser of an offshore vessel to control a position of the riser in a subsea environment while the riser is suspended from the offshore vessel and decoupled from a seafloor, wherein the GTDS comprises a first detachable thrust unit configured to be detached from a first location of the riser and to be removably attached to a second location of the riser while the riser is in the subsea environment, wherein the first detachable thrust unit comprises one or more thrusters of the plurality of thrusters.

2. The system of claim 1, wherein the plurality of thrusters comprises an azimuthing thruster configured to generate a force in a lateral direction, wherein the azimuthing thruster is configured to rotate about a respective axis to adjust the lateral direction of the force.

3. The system of claim 1, wherein the GTDS comprises a second thrust unit permanently affixed to the riser.

4. The system of claim 1, wherein the plurality of thrusters is disposed about the thrust unit to generate forces in a first lateral direction, a second lateral direction perpendicular to the first lateral direction, and a vertical direction.

5. The system of claim 1, wherein the plurality of thrusters comprises:

a first thruster configured to generate a first force in a first lateral direction; and a second thruster configured to generate a second force in a second lateral direction different than the first lateral direction.

6. The system of claim 5, wherein the plurality of thrusters is configured to control the position of the riser in the subsea environment to maintain a minimum distance between the riser and subsea structures of the subsea environment, wherein the minimum distance is between 5 to 100 ft, wherein the riser comprises subsea equipment coupled to or near an end of the riser.

7. The system of claim 1, wherein the GTDS is coupled to subsea equipment disposed at or near an end of the riser, wherein the GTDS is configured to indirectly control the position of the riser in the subsea environment while the riser is suspended from the offshore vessel and decoupled from the seafloor.

8. The system of claim 7, wherein the subsea equipment comprises a blow out preventer attached to the riser, and the GTDS is coupled to the blow out preventer.

9. The system of claim 1, comprising a skid coupled to the riser at the first location, wherein the skid comprises a plurality of detachable thrust units, the plurality of detachable thrust units comprises the first detachable thrust unit and a second detachable thrust unit, each detachable thrust unit comprises at least one thruster of the plurality of thrusters, wherein each detachable thrust unit is configured to detach from the skid, to couple to the riser at a respective location different than the first location, and to generate a respective force on the riser at the respective location.

10. The system of claim 9, wherein the plurality of thrusters comprises skid thrusters disposed on the skid.

11. A guidance thrust delivery system (GTDS), comprising:

a plurality of thrust units configured to be coupled to a riser of an offshore vessel, to subsea equipment coupled to the riser, or any combination thereof, wherein the plurality of thrust units is configured to generate one or more forces on the riser of the offshore vessel to control a position of the riser in a subsea environment while the riser is suspended from the offshore vessel through an opening of the offshore vessel and decoupled from a seafloor, wherein the plurality of thrust units comprises a first detachable thrust unit configured to be detached from a first location on the riser or subsea equipment and to be removably attached to a second location on the riser or subsea equipment while in the subsea environment; and a controller coupled to the plurality of thrust units, wherein the controller is configured to control the plurality of thrust units to generate the one or more forces on the riser based at least in part on an orientation of the riser relative to the opening of the offshore vessel.

12. The guidance thrust delivery system of claim 11, comprising a power source coupled to the plurality of thrust units and configured to supply power to the plurality of thrust units, wherein the power source is configured to be disposed in the subsea environment when the plurality of thrust units generate one or more forces on the riser.

13. The guidance thrust delivery system of claim 11, comprising one or more sensors configured to sense the position of the riser in the subsea environment relative to a subsea structure, an orientation of the riser in the subsea environment, or any combination thereof.

14. The guidance thrust delivery system of claim 13, wherein the controller is configured to control the plurality of thrusters to generate forces on the riser to maintain a minimum distance between the riser and the subsea structure of the subsea environment based at least in part on data from the one or more sensors.

15. The guidance thrust delivery system of claim 11, comprising umbilical lines coupled between the plurality of thrust units and the controller, wherein the controller is remotely disposed on the offshore vessel.

16. The guidance thrust delivery system of claim 11, wherein the plurality of thrust units comprises a second detachable thrust units, and the second detachable thrust unit is configured to be detached from a third location on the riser or the subsea equipment and to be removably attached to a fourth location on the riser or the subsea equipment while in the subsea environment.

17. A method comprising:

controlling a guidance thrust delivery system (GTDS) to control a position of a riser in a subsea environment while the riser is suspended from an offshore vessel through an opening of the offshore vessel and decoupled from a seafloor, wherein the GTDS is coupled to the riser of the offshore vessel, to subsea equipment coupled to the riser, or any combination thereof, wherein the GTDS comprises a plurality of thrusters, and the plurality of thrusters is configured to generate one or more forces on the riser of the offshore vessel to control the position of the riser based at least in part on an orientation of the riser relative to the opening of the offshore vessel; and adjusting an angle of a respective force of the one or more forces on the riser, wherein adjusting the angle of the respective force comprises:

detaching a first detachable thrust unit of the GTDS from a first location of the riser; and removably coupling the first detachable thrust unit to a second location of the riser.

18. The method of claim 17, comprising:

determining a distance between the riser and a subsea structure in the subsea environment; and controlling the plurality of thrusters to generate the one or more forces to control the position of the riser in the subsea environment to maintain a minimum desired distance between the riser and the subsea structure, wherein the minimum desired distance is between 5 to 100 ft.

19. The method of claim 17, comprising controlling the plurality of thrusters remotely on the offshore vessel by control signals generated remotely and transmitted to the GTDS.

* * * * *